US008864290B2

(12) United States Patent
Osawa et al.

(10) Patent No.: US 8,864,290 B2
(45) Date of Patent: Oct. 21, 2014

(54) INSTALLING FLUID CONTAINER IN FLUID EJECTION DEVICE

(71) Applicant: Seiko Epson Corporation, Tokyo (JP)

(72) Inventors: Tatsuro Osawa, Nagano-ken (JP); Hiroyuki Sugimoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/970,383

(22) Filed: Aug. 19, 2013

(65) Prior Publication Data

US 2013/0335491 A1 Dec. 19, 2013

Related U.S. Application Data

(63) Continuation of application No. 12/142,436, filed on Jun. 19, 2008, now Pat. No. 8,534,806.

(30) Foreign Application Priority Data

Jun. 20, 2007 (JP) ..... 2007-162216
May 22, 2008 (JP) ..... 2008-133804

(51) Int. Cl.
*B41J 2/17* (2006.01)
*B41J 2/175* (2006.01)
*B41J 29/13* (2006.01)

(52) U.S. Cl.
CPC ..... *B41J 2/17523* (2013.01); *B41J 2/175* (2013.01); *B41J 2/17553* (2013.01); *B41J 2/17509* (2013.01); *B41J 2/1752* (2013.01)
USPC ..... 347/84; 347/86; 347/108

(58) Field of Classification Search
None
See application file for complete search history.

(56) References Cited

U.S. PATENT DOCUMENTS

| | | | |
|---|---|---|---|
| 4,878,069 | A | 10/1989 | Kiyohara |
| 5,710,585 | A | 1/1998 | Sabonis et al. |
| 6,082,854 | A | 7/2000 | Axtell et al. |
| 6,106,112 | A | 8/2000 | Okubo et al. |
| 6,244,698 | B1 | 6/2001 | Chino et al. |
| 6,264,318 | B1 | 7/2001 | Oda et al. |
| 6,302,535 | B1 | 10/2001 | Sturgeon et al. |
| 6,669,385 | B1 | 12/2003 | King et al. |

(Continued)

FOREIGN PATENT DOCUMENTS

| | | | |
|---|---|---|---|
| CN | 1526559 | A | 9/2004 |
| EP | 0 839 659 | A1 | 5/1998 |

(Continued)

OTHER PUBLICATIONS

U.S. Appl. No. 13/287,504, Office Action, mailing date Jan. 26, 2012, paper No./mail date Jan. 17, 2012.
U.S. Appl. No. 12/142,469, Office Action, mailing date Jan. 13, 2011.
U.S. Appl. No. 12/142,529, Office Action, mailing date Aug. 26, 2010.

(Continued)

*Primary Examiner* — Matthew Luu
*Assistant Examiner* — Renee I Wilson

(57) ABSTRACT

A fluid ejection device includes a fluid ejection unit that ejects a fluid onto an ejection target; a main chassis case that includes a platen disposed in a area for ejecting the fluid by the fluid ejection unit; a container case for containing a pack, the pack containing a fluid for ejection, wherein the container case is pivotably attached to the main chassis case and openable by rotation about a rotation shaft; and a delivery tube that delivers the fluid from the pack to the fluid ejection unit.

8 Claims, 11 Drawing Sheets

(56) References Cited

U.S. PATENT DOCUMENTS

| | | | | |
|---|---|---|---|---|
| 6,722,762 | B2 | 4/2004 | Miyazawa et al. | |
| 6,848,775 | B2 | 2/2005 | Ishizawa et al. | |
| 6,908,182 | B2 | 6/2005 | Nakazawa et al. | |
| 7,077,512 | B2 | 7/2006 | Kobayashi et al. | |
| 7,097,294 | B2 | 8/2006 | Ishizawa et al. | |
| 7,225,153 | B2 | 5/2007 | Lange | |
| 7,244,009 | B2 | 7/2007 | Kobayashi et al. | |
| 7,290,869 | B2 | 11/2007 | Hanaoka | |
| 7,303,269 | B2 * | 12/2007 | Shiota | 347/85 |
| 7,334,884 | B2 * | 2/2008 | Shiota | 347/85 |
| 7,488,067 | B2 | 2/2009 | Ishizawa et al. | |
| 7,845,750 | B2 | 12/2010 | Kobayashi et al. | |
| 2001/0040613 | A1 | 11/2001 | Nakazawa et al. | |
| 2002/0109760 | A1 | 8/2002 | Miyazawa et al. | |
| 2005/0057624 | A1 | 3/2005 | Hanaoka | |
| 2005/0168545 | A1 | 8/2005 | Sakai et al. | |
| 2008/0315384 | A1 | 12/2008 | Jacobsen et al. | |
| 2008/0316283 | A1 | 12/2008 | Osawa et al. | |
| 2008/0316284 | A1 | 12/2008 | Osawa et al. | |

FOREIGN PATENT DOCUMENTS

| | | | |
|---|---|---|---|
| JP | 60-110216 | U | 7/1985 |
| JP | 03-184873 | A | 8/1991 |
| JP | 09-048422 | A | 2/1997 |
| JP | 2000-229421 | A | 8/2000 |
| JP | 2001-278239 | A | 10/2001 |
| JP | 2002-019877 | A | 1/2002 |
| JP | 2002-200749 | A | 7/2002 |
| JP | 2003-053984 | A | 2/2003 |
| JP | 2003-170611 | A | 6/2003 |
| JP | 2004-155036 | A | 6/2004 |
| JP | 2004-284353 | A | 10/2004 |
| JP | 2004-306340 | A | 11/2004 |
| JP | 2005-047258 | A | 2/2005 |
| JP | 2005-297286 | A | 10/2005 |
| JP | 2006-192664 | A | 7/2006 |
| JP | 2007-083680 | A | 4/2007 |
| JP | 2007-136748 | A | 6/2007 |

* cited by examiner

INSTALLING FLUID CONTAINER IN FLUID EJECTION DEVICE

CROSS-REFERENCE TO RELATED APPLICATIONS

This application is a continuation of, and claims priority under 35 U.S.C. §120 on, U.S. patent application Ser. No. 12/142,436, filed Jun. 19, 2008, which claims priority under 35 U.S.C. §119 on Japanese patent application nos. 2007-162216 and 2008-133804, filed Jun. 20, 2007 and May 22, 2008 respectively. The content of each such related application is incorporated by reference herein in its entirety.

BACKGROUND

1. Technical Field

The present invention relates to a fluid ejection device for ejecting a fluid, and particularly to a structure by which fluid-containing packs containing fluid for ejection are positioned within the fluid ejection device.

2. Related Art

Printers of ink jet format, which eject drops of ink onto thin sheets of a recording medium such as paper or plastic in order to record text or images thereon, are a representative type of fluid ejection device. Other types of fluid ejection devices include those adapted for use in display production systems employed in the production of liquid crystal displays, plasma displays, organic EL (Electro Luminescence) displays, field emission displays (FED), and the like, and used for ejecting various types of liquid materials to form coloring material, electrodes, etc. in the pixel regions or electrode regions.

A typical fluid ejection device is equipped with a carriage on which rides an ejection head for ejecting fluid onto an ejection target; the location for fluid ejection onto the ejection target is adjusted by moving either the carriage or the recording medium, or both. Where a fluid ejection device employs a system in which a container portion containing fluid for ejection is positioned apart from the carriage (known as an off-carriage system) it will be possible to reduce the load associated with driving the carriage. Patent Citation JP 2005-47258 A discloses such a printer of off-carriage type in which an ink cartridge containing ink packs is inserted into the printer unit.

SUMMARY

However, in the past, sufficient consideration was not given to a design able to accommodate fluid containers of larger capacity. For example, there were problems such as the difficulty of ensuring sufficient space within the unit between the fluid containers and other structures; and damage to other structures inside the unit due to operator error when installing the fluid container within the unit.

In view of the issues discussed above, it is an object of the invention to provide a fluid ejection device able to accommodate larger capacity fluid containers.

An advantage of some aspects of the invention is intended to address this issue at least in part, and can be reduced to practice as described below.

A fluid ejection device according to an aspect of the invention comprises a fluid ejection unit that ejects a fluid onto an ejection target; a main chassis case that includes a platen disposed in an area for ejecting the fluid by the fluid ejection unit; a container case for containing a pack, the pack containing a fluid for ejection, the container case being pivotably attached to the main chassis case and openable by rotation about a rotation shaft; and a delivery tube that delivers the fluid from the pack to the fluid ejection unit.

The container case may be pivotably attached to the main chassis case so as to allow a part above the platen to be opened and closed. The fluid ejection device may also further comprise a delivery needle that includes a hollow flow passage connecting with the delivery tube. In such arrangement, the delivery needle is adapted to connect with an aperture of the pack and arranged along the rotation shaft in the container case.

The invention is not limited to being embodied as a fluid ejection device, and may be reduced to practice as a method for manufacture thereof, or other mode having a structure for accommodating fluid-containing packs. The invention should not be construed as limited to the embodiments set forth hereinabove, and naturally various modifications such as the following may be made herein without departing from the scope of the invention.

These and other objects, features, aspects, and advantages of the invention will become more apparent from the following detailed description of the preferred embodiments with the accompanying drawings.

BRIEF DESCRIPTION OF THE DRAWINGS

The invention will be described with reference to the accompanying drawings in which.

DESCRIPTION OF THE PREFERRED EMBODIMENTS

A better understanding of the constitution and advantages of the invention set forth above will be provided through the following description of the invention embodied in a fluid ejection device. In the embodiment, a printer of ink-jet type will be described as an example representative of a picture recording device, as one embodiment of a fluid ejection device.

A. Embodiment

Figure 1:
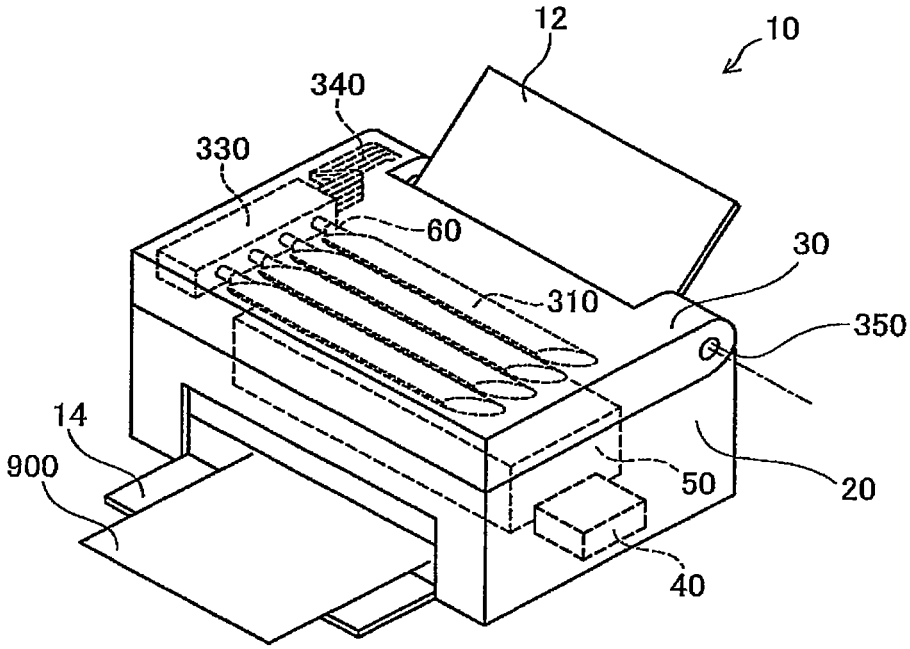
FIG. 1 is an illustration depicting in simplified form a configuration of a printer.

FIG. 1 is an illustration depicting in simplified form the design of a printer 10. The printer 10 is a printer of ink-jet type which records text and images by ejecting ink drops onto a recording medium, namely, printer paper 900. The printer 10 includes a main chassis unit 20 which houses a printing mechanism section 50 constituting the fluid ejecting portion for ejecting ink drops onto the printer paper 900; the main chassis unit 20 houses a paper feed tray 12 for loading into the interior of the main chassis unit 20 the printer paper 900 which is to be supplied to the printing mechanism section 50, as well as a paper output tray 14 for guiding out from the main chassis unit 20 the printer paper 90 which has been discharged from the printing mechanism section 50. The specifics of the design of the printing mechanism section 50 will be discussed later.

Also housed in the main chassis unit 20 is a controller section 40 for controlling the various parts of the printer 10. In the embodiment, the controller section 40 includes ASICs (Application Specific Integrated Circuits) furnished with hardware such as a central processing unit (CPU), read only memory (ROM), and random access memory (RAM). Software for accomplishing the various functions of the printer 10 is installed in the controller section 40.

On the upper face of the main chassis unit 20 is installed an upper chassis unit 30 which constitutes the container case for accommodating a plurality of ink packs 310 which constitute the container portions respectively containing liquid inks of different colors. The upper chassis unit 30 is pivotably attached to the main chassis unit 20 so as to open and close about a rotation shaft 350.

In the embodiment, the ink packs 310 take the form of flat bag portions of generally rectangular shape made of pliable sheeting and having generally elliptical cross section; a pack aperture 60 serving as the withdrawal opening from which ink may be withdrawn is provided on one of the short sides. The specific design of the pack aperture 60 will be discussed later. In the embodiment, the plurality of ink packs 310 are held stacked on an incline with one long side thereof upraised. In the embodiment, the upper chassis unit 30 accommodates four ink packs 310 for individual inks of the four colors black, cyan, magenta, and yellow. In an alternative embodiment, in a printer adapted to carry out printing with light cyan and light magenta in addition to these four colors for a total of six colors, the upper chassis unit 30 could be designed to accommodate six ink packs 310 for individual inks of six colors including the additional light cyan and light magenta.

The upper chassis unit 30 which constitutes the ink delivery unit for the printing mechanism section 50 has an ink delivery section 330 which connects to the ink packs 310 so as to enable ink to be dispensed from them. A delivery tube 340 which defines a fluid passage allowing the ink dispensed from the ink packs 310 to flow down to the printing mechanism section 50 connects with the ink delivery section 330. The delivery tube 340 can be fabricated of material having gas barrier properties, for example, a thermoplastic elastomer such as an olefin or styrene.

Figure 2:
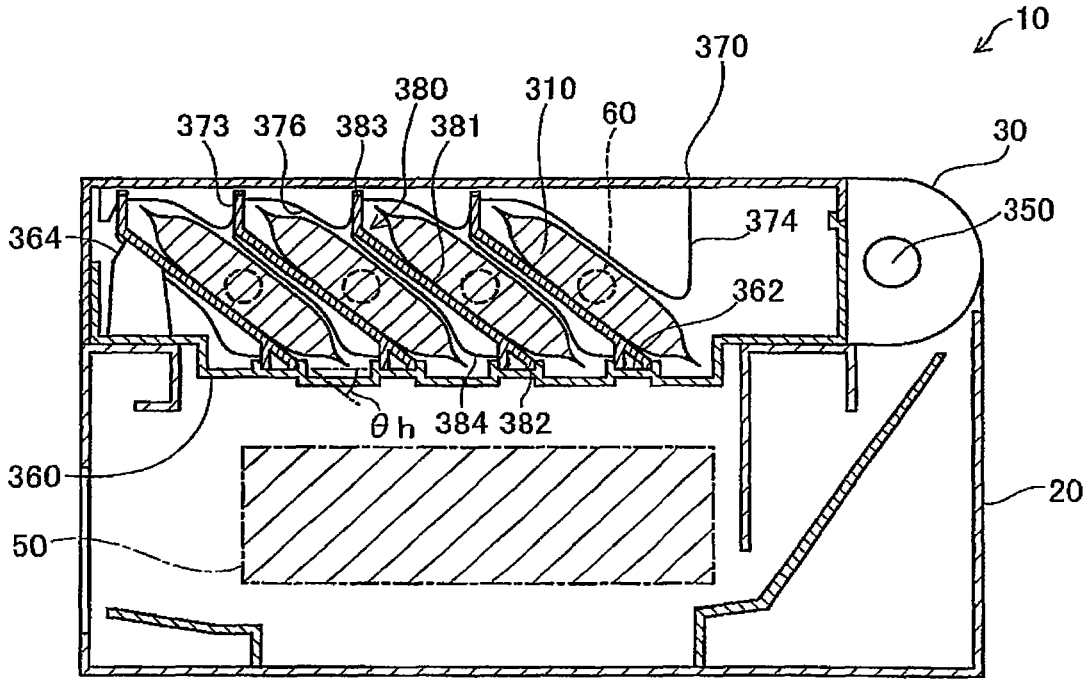
FIG. 2 is a sectional view depicting in simplified form the configuration of the printer with the upper chassis unit closed.
Figure 3:
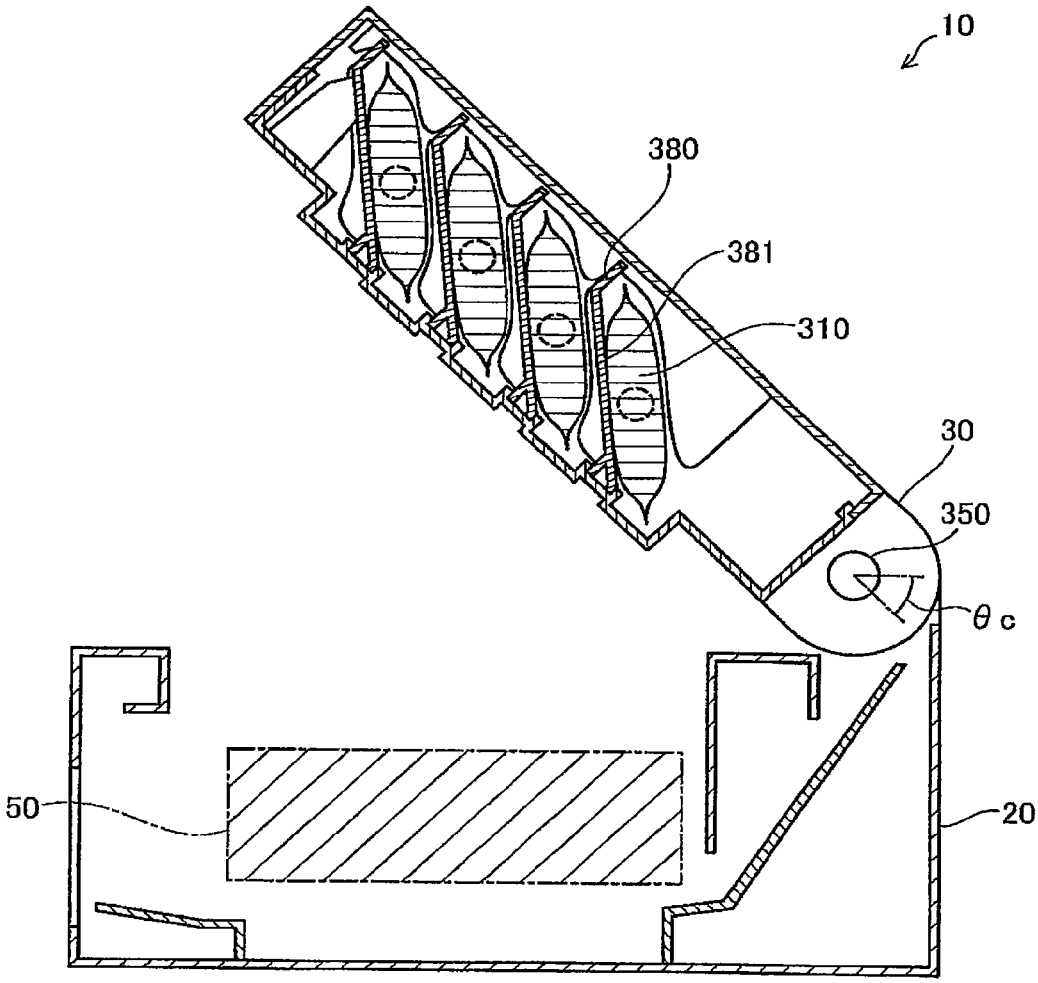
FIG. 3 is a sectional view depicting in simplified form the configuration of the printer with the upper chassis unit open.
Figure 4:
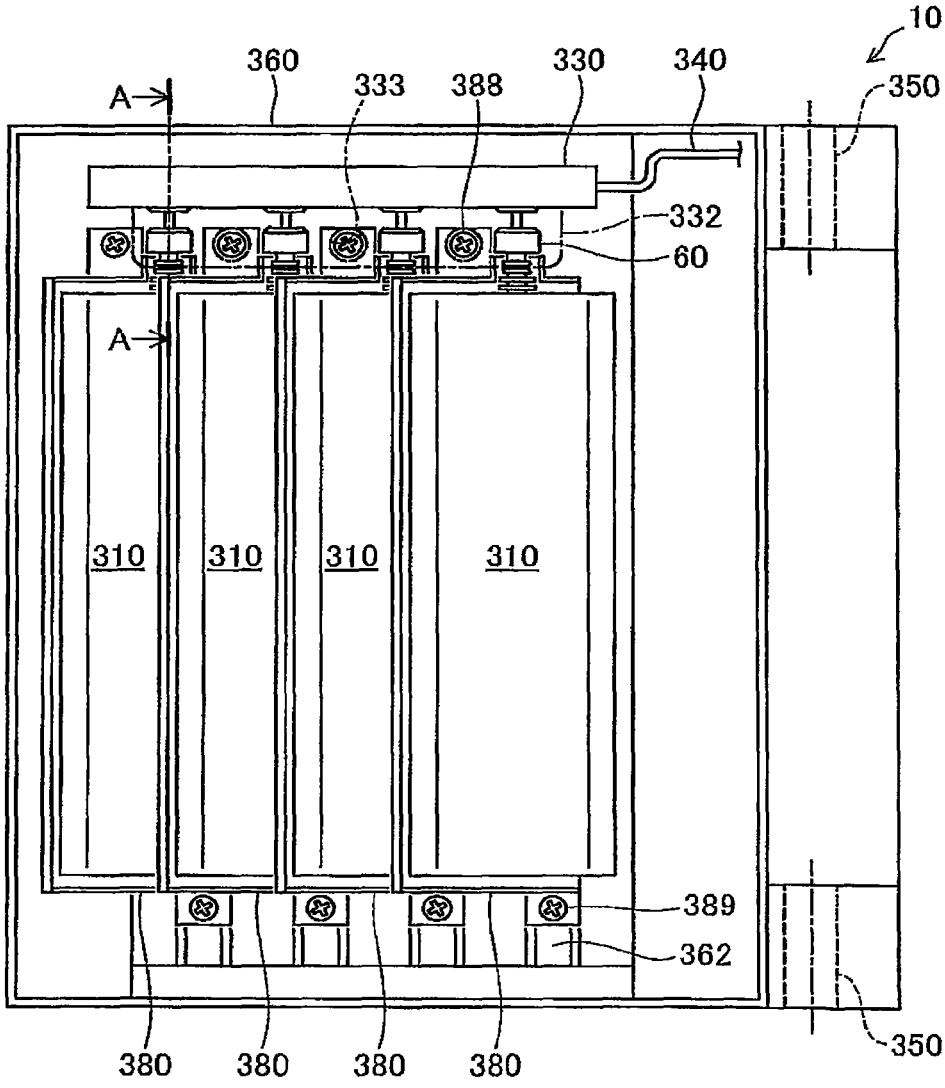
FIG. 4 is a top view showing the interior of the upper chassis unit.

FIG. 2 is a sectional view depicting in simplified form the configuration of the printer 10 with the upper chassis unit 30 closed. FIG. 3 is a sectional view depicting in simplified form the configuration of the printer 10 with the upper chassis unit 30 open. FIG. 4 is a top view showing the interior of the upper chassis unit 30. The upper chassis unit 30 has a lower housing 360 which constitutes the inside lower face of the upper chassis unit 30; and an upper housing 370 which constitutes the inside top wall of the upper chassis unit 30. Inside the lower housing 360 are disposed a plurality of holder guides 362 constituted in sections of the inside lower face defined by the lower housing 360, and extending approximately parallel to the rotation shaft 350 and spaced at approximately equal intervals apart from one another. As shown in FIG. 3, in the embodiment, the upper part of the printing mechanism section 50 housed within the main chassis unit 20 will lie exposed by opening the upper chassis unit 30.

As shown in FIG. 2, a plurality of holders 380 on which the ink packs 310 rest are provided as liquid containers within the upper chassis unit 30. The holders 380 have inclined panels 381 which are inclined with respect to the holder guides 362. The ink packs 310 are arranged resting against the upper faces of the inclined panels 381 of the holders 380, with one side face of the flat bag which makes up the ink pack 310 in contact therewith. In the embodiment, the ink packs 310 are attached with double-sided tape on at least a portion of the face thereof contacting the inclined panel 381 of the holder 380. In the lower section of the inclined panel 381 of the holder 380 there is formed a base section 382 which is fittable within the holder guide 362. After the base section 382 has been fitted into the holder guide 362, the holder 380 will be secured fastened to the lower housing 360 by fastening screws 388, 389 which constitute the fastening components. The plurality of holders 380 are positioned in a row staggered along the inside lower face of the lower housing 360, with the inclined panel 381 of one holder 380 overlapping the top of the ink pack 310 which rests on another holder situated adjacently in the direction of incline of the inclined panels 381. As depicted in FIGS. 2 and 3, the inclined panels 381 of the holders 380 are inclined with respect to the holder guides 362 of the lower housing 360, by an angle of incline θh enabling them to remain in contact with the ink packs 310 from below in the direction of gravity as the upper chassis unit 30 moves from the closed position to the open position. In the embodiment, the allowable rotation angle θc for opening and closing of the upper chassis unit 30 about the rotation shaft 350 is approximately 45 degrees, whereas the angle of incline θh of the inclined panels 381 with respect to the holder guides 362 is approximately 40 degrees.

As shown in FIG. 2, on the back face of the inclined panel 381 of each holder 380 is pendently disposed a back face reinforcing rib 384 having a tabular contour which extends along the ink pack 310 resting on the adjacent holder 380. On the inside lower face of the lower housing 360 is disposed a holder reinforcing rib 364 of tabular contours which rises up to meet the bottom of the inclined panel 381 of the holder 380 situated at the end in the direction of incline of the inclined panels 381 in the row of holders 380. In the embodiment, the upper part of the holder reinforcing rib 364 abuts the back face of the inclined panel 381 of this holder 380. On the inside top wall of the upper chassis unit 30 is pendently disposed an end portion reinforcing rib 374 having a tabular contour which extends towards the upside of the ink pack 310 resting on the holder 380 situated at the end opposite from the direction of incline of the inclined panels 381 in the row of holders 380. On the inside top wall of the upper chassis unit 30 is also pendently disposed a medial reinforcing rib of tabular contours which extends along the upside of the ink pack 310 resting on the holder 380, along a zone sandwiched between two of the holders 380. Also disposed on the inside top wall of the upper chassis unit 30 is a mating portion 373 which mates with the upper edge portion 383 of the inclined panel 381 of a holder 380.

As shown in FIG. 4, the ink delivery section 330 has a guard cover 332 disposed covering the upside of the connector portions with the pack apertures 60 of the ink packs 310. The guard cover 332 has openings 333 to permit insertion of a tool for tightening fastening screws 388 which fasten the holders 380 to the lower housing 360.

Figure 5:
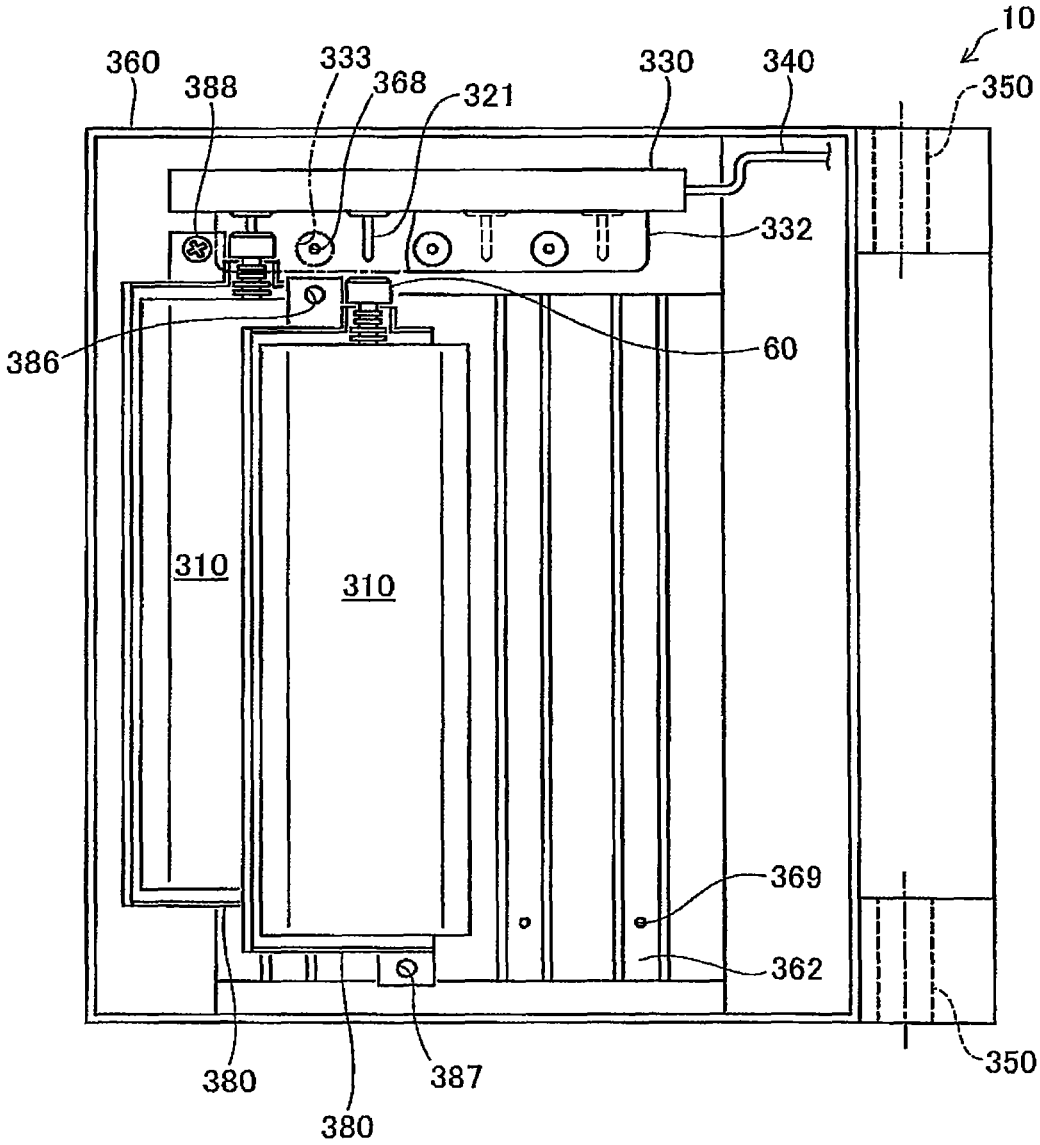
FIG. 5 is an illustration depicting fastening of holders carrying ink packs within the upper chassis unit.

FIG. 5 is an illustration depicting fastening of holders 380 carrying ink packs 310 within the upper chassis unit 30. In each of the holders 380, a through hole 386 adapted for passage and engagement of a fastening screw 388 is formed at a location adjacent to the pack aperture 60 of the ink pack 310, and a through hole 387 adapted for passage and engagement of a fastening screw 388 is formed at a location adjacent to the opposite end from the pack aperture 60 of the ink pack 310. In the lower housing of the upper chassis unit 30, at fastening locations where the holders 380 carrying the ink packs 310 are to be fastened, there are formed screw holes 368 for threadably engaging the fastening screws 388 passed through the through holes 386 of the holders 380, as well as screw holes 369 for threadably engaging the fastening screws 389 passed through the through holes 387 of the holders 380.

During the process of fastening the holders 380 carrying the ink packs 310 in the interior of the upper chassis unit 30, first, the base portion 382 of the holder 360 carrying the ink pack 310 is fitted from above into one of the holder guides 362 of the lower housing 360. Then, the holder 380 is slid along the holder guide towards a delivery needle 320 until the delivery needle 320 is threaded through the aperture of the ink pack 310. The holder 380 is then fastened to the lower housing 360 with the fastening screws 388, 389.

Figure 6:
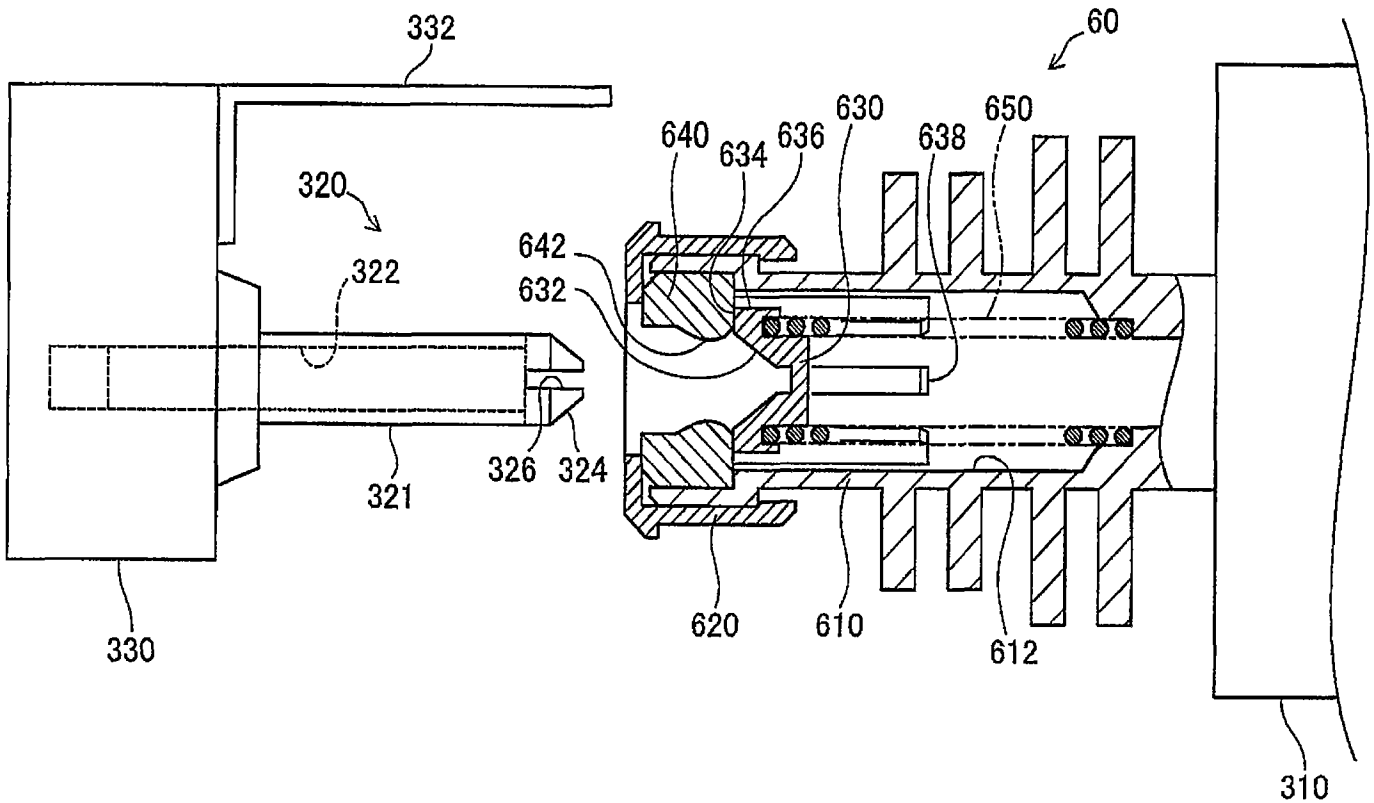
FIG. 6 is an illustration depicting an ink pack prior to connection with the ink delivery section, viewed in A-A cross section in FIG. 4.
Figure 7:
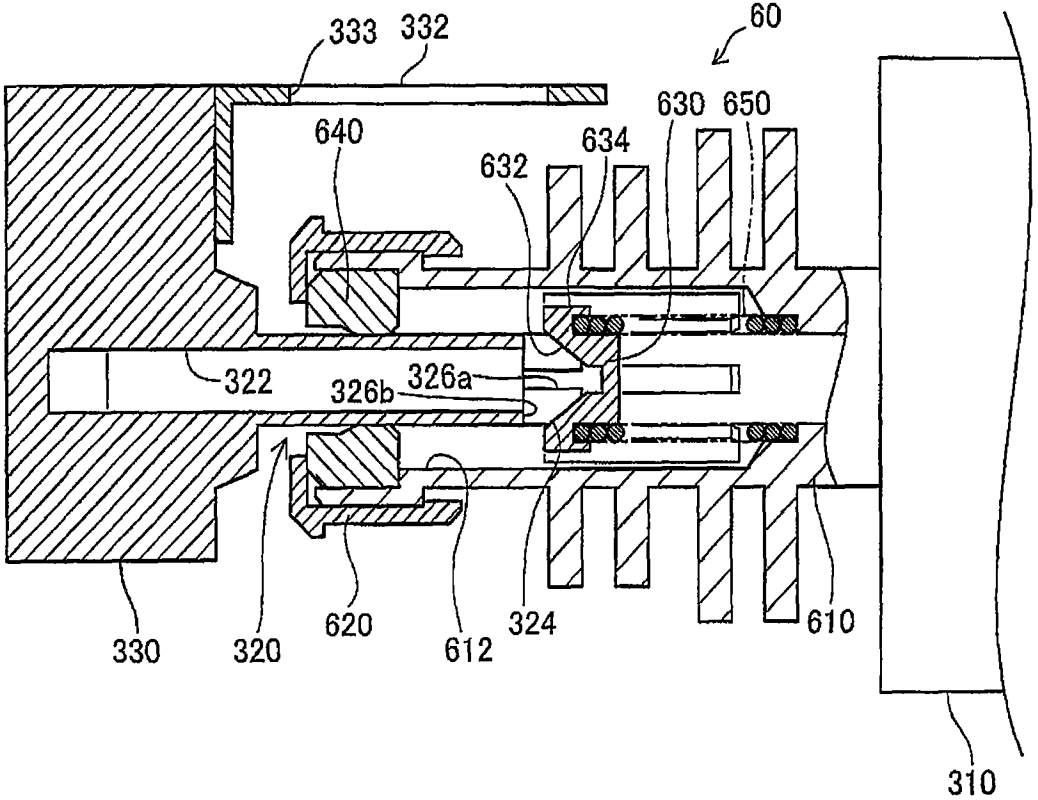
FIG. 7 is an illustration depicting an ink pack connected with the ink delivery section, viewed in A-A cross section in FIG. 4.

FIG. 6 is an illustration depicting an ink pack 310 prior to connection with the ink delivery section 330, viewed in A-A cross section in FIG. 4. FIG. 7 is an illustration depicting an ink pack 310 connected with the ink delivery section 330, viewed in A-A cross section in FIG. 4. The delivery needles 320, each of which has a hollow flow passage 322 communicating with the delivery tube 340, are provided to the ink delivery section 330. A first end of the delivery needle 320 has a tip 324 of tapered shape. A delivery channel 326 which communicates with the hollow flow passage 322 is formed in the tip 324 of the delivery needle 320. The delivery channel 326 is formed from the tip of the delivery needle 320 to a side wall 321 which extends generally along the center axis of the delivery needle 320. As shown in FIG. 7, the delivery channel 326 of the delivery needle 320 is defined by a vertical face 326*a* which extends generally along the center axis of the delivery needle 320, and a lateral face 326*b* which intersects the center axis of the delivery needle 320. In the embodiment, the delivery channel 326 of the delivery needle 320 is formed with a cross shape ("+ (plus)" shape) having its intersection point at the center axis of the delivery needle 320. In the embodiment, the delivery needle 320 is a resin component which has been integrally molded with the ink delivery section 330 using a mold.

The pack aperture 60 provided to each of the ink packs 310 is provided with a delivery aperture portion 610 having formed therein a delivery aperture 612 which communicates with the interior of the ink pack 310. A cylindrical gasket 640 having a through hole 642 which mates intimately with the delivery needle 320 threaded through the delivery aperture 612 is disposed at the inlet of the delivery aperture 612. The gasket 640 installed in the delivery aperture 612 is forced into the delivery aperture 612 by a cap 620 which fits onto the delivery aperture portion 610.

A valve body 630 having a sealing face 634 that intimately attaches to the gasket 640 is housed within the delivery aperture 612. The valve body 630 housed within the delivery aperture 612 is urged towards the gasket 640 from the interior of the delivery aperture 612 by a coil spring 650 which constitutes a resilient member, and seals off the through hole 642 of the gasket 640. The valve body 630 is provided with a plurality of guides 638 disposed contacting the inside wall of the delivery aperture 612 generally along the center axis of the delivery aperture 612; between the plurality of guides 638 are defined offset faces 636 which are offset from the inside face of the delivery aperture 612. A mating face 632 adapted to mate with the tip 324 of the delivery needle 320 is formed on the valve body 630 on the side thereof which abuts the gasket 640.

As shown in FIG. 7, when the delivery needle 320 is threaded through the through-hole 642 of the gasket 640, with the tip 324 of the delivery needle 320 mated with the mating face 632 of the valve body 630, the valve body 630 will be pushed inward towards the ink pack 310 within the delivery aperture 612. During this process, since the delivery channel 326 of the delivery needle 320 has been formed so as to extend from the tip 324 to the side wall 321 and beyond the mating face 632 of the valve body 630, the channel will now communicate with the delivery aperture 612. The interior of the ink pack 310 will thereby be placed in communication with the hollow flow passage 322 of the delivery needle 320, via the offset faces 636 of the valve body 630 and the delivery channel 326 of the delivery needle 320.

Figure 8:
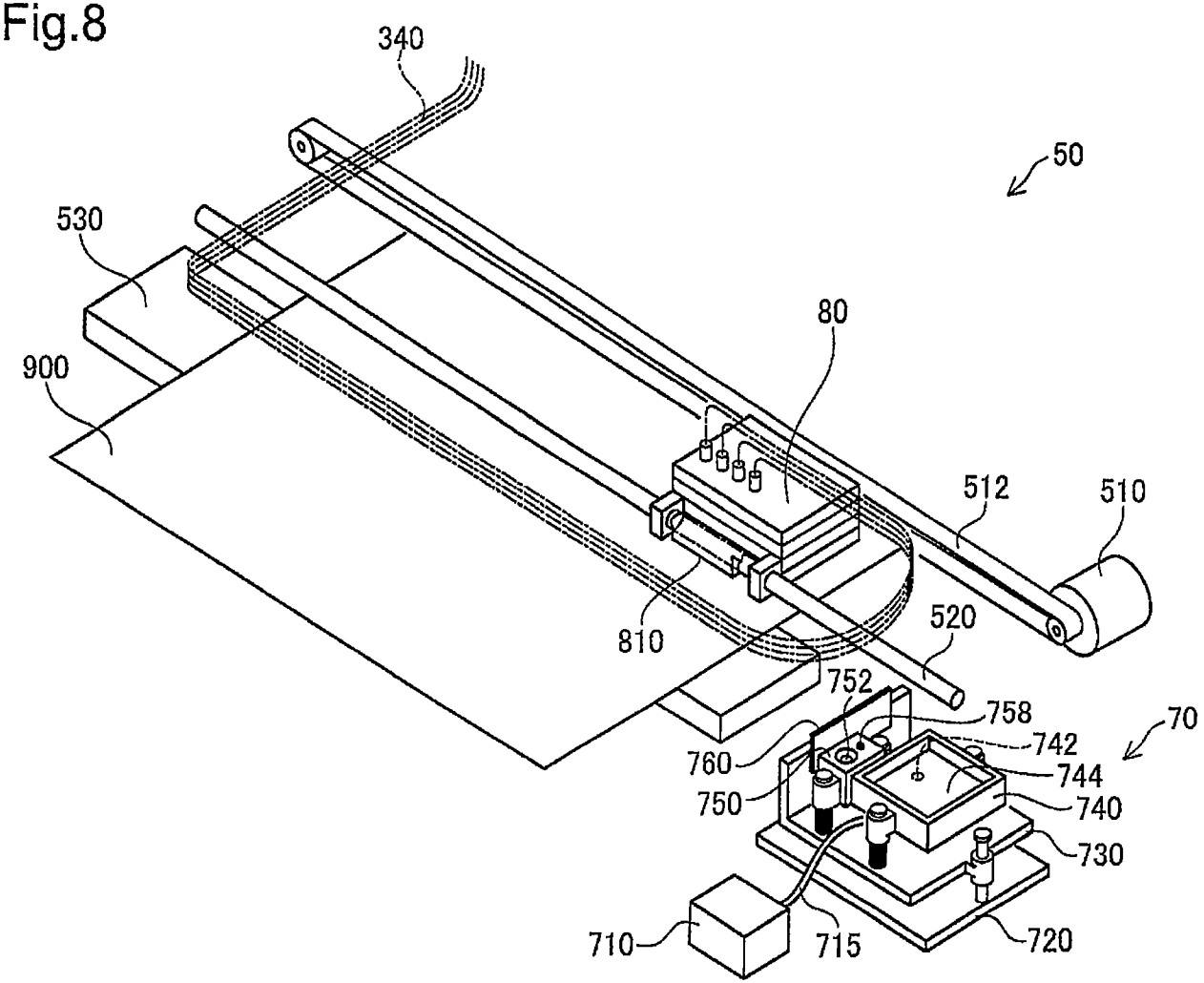
FIG. 8 is an illustration depicting a configuration of a printing mechanism section of a printer.

FIG. 8 is an illustration depicting a configuration of the printing mechanism section 50 of the printer 10. The printing mechanism section 50 has a platen 530 of rectangular shape disposed in a printing area where ejection of ink drops onto the printer paper 900 will be carried out. The printer paper 900 is transported over the platen 530 by a paper feed mechanism (not shown). The printing mechanism section 50 also has a carriage 80 which is connected to the delivery tube 340 and which carries an ejection head 810. The carriage 80 is moveably supported in the lengthwise direction of the platen 530 along a guide rod 520, and is driven via a timing belt 512 by a carriage motor 510 which constitutes the carriage driving section. The carriage 80 thereby undergoes reciprocating motion in the lengthwise direction over the platen 530. In the interior of the main chassis unit 20, a home position where the carriage 80 waits in standby is provided in a nonprinting area away to one side of the printing area where the platen 530 is located. A maintenance mechanism section 70 for maintenance of the carriage 80 is disposed at this home position.

Figure 9:
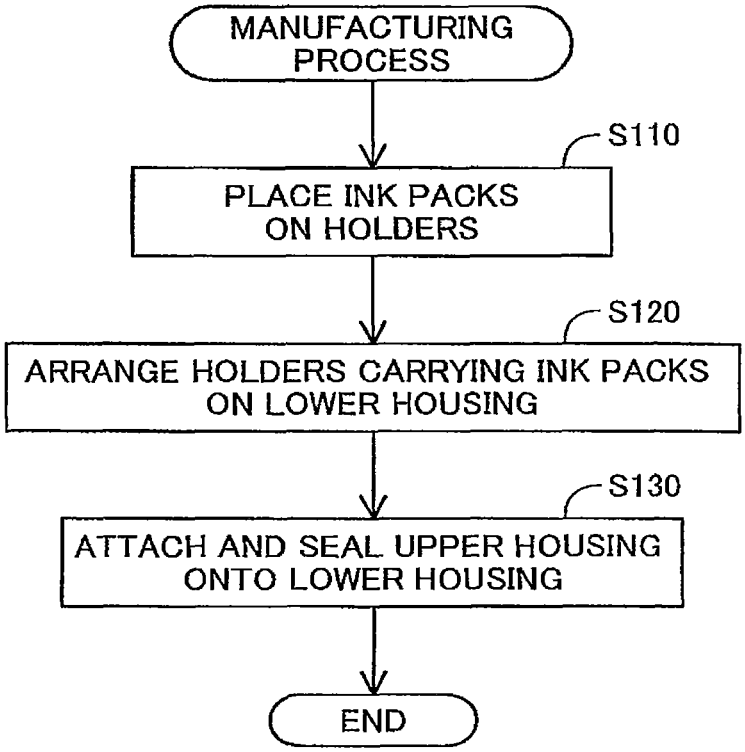
FIG. 9 is a flowchart depicting a method of manufacturing the printer.

FIG. 9 is a flowchart depicting a method of manufacturing the printer 10. When installing the ink packs 310 in the printer 10, first, the ink-filled ink packs 310 are positioned on the inclined panels 381 of the holders 380 (Step S110). The holders 380 carrying the ink packs 310 are then fitted into the holder guides 362 of the lower housing 360, and the holders 380 are fastened to the lower housing 360 with the fastening screws 388, 389 so that the plurality of holders 380 are arranged on the lower housing 360 (Step S120). Subsequently, the lower housing in which the plurality of holders 380 have been arranged is sealed with the upper housing 370, whereby the plurality of ink packs 310 are housed in the interior of the main chassis unit 30 (Step S130).

According to the printer 10 of the embodiment described above, since the guard cover 332 is disposed projecting out over the delivery needle 320, it is possible to prevent accidental damage to the delivery needle 320 when the holder 380 carrying the ink pack 310 is secured to the lower housing 360. Additionally, by working through the openings 333 provided in the guard cover 332 the fastening screws 388 can be passed through the through holes 386 of the holders 380 and fastened into the screw holes 386 of the lower housing 360, and thus while preventing accidental damage to the delivery needle 320 when the holder 380 carrying the ink pack 310 is secured to the lower housing 360, the holder 380 can be secured to the lower housing 360 in the vicinity of connection between the delivery needle 320 and the pack aperture 60.

Moreover, because by opening the upper chassis unit 30 it is possible to access parts of the main chassis unit 20 which are normally covered by the upper chassis unit 30, the degree of freedom in positioning of the ink packs 310 can be improved. Moreover, because the upper chassis unit 30 is pivotably attached to the main chassis unit 20 allowing the top part of the printing mechanism section 50 to be opened or closed, the upper chassis unit 30 which houses the ink packs 310 can be utilized as the cover for the printing mechanism section 50; and by opening the upper chassis unit 30 it will be possible to easily perform maintenance on the printing mechanism section 50 housed within the main chassis unit 20.

Moreover, because the individual ink packs 310 respectively rest on the inclined panels 381 of the holders 380, the plurality of ink packs 310 can be stacked and accommodated efficiently, while preventing the weight of ink packs 310 from bearing on neighboring ink packs 310. Additionally, because the ink packs 310 are retained from below as the upper chassis unit 30 moves from the closed state to the open state, the ink packs 310 can be prevented from pushing with excessive force against neighboring holders 380 due to gravity.

Furthermore, by disposing the holder reinforcing rib 364 on the lower housing 360, the holder 380 can be reinforced with respect to force acting in the direction of incline of the inclined panels 381. Moreover, by disposing the end portion reinforcing rib 374 on the upper housing 370, it will be possible to avoid excessive deformation of the ink pack 310 carried on the holder 380 which is situated at the end opposite the direction of incline of the inclined panels 381. Additionally, by disposing the medial reinforcing rib 376 on the upper housing 370, it will be possible to avoid excessive deformation at the upside of an ink pack 310 unsupported by the back face of the inclined panel 381 of the adjacent holder. Furthermore, because the upper edge portion 383 of the inclined panel 381 of the holder 380 mates with the mating portion 373 disposed on the upper housing 370, it is possible to prevent the holder 380 from experiencing excessive deformation.

B. Alternative Embodiments

The foregoing description of the invention based on certain preferred embodiments should not be construed as limiting of the invention, and various modifications will of course be possible without departing from the scope of the invention. For example, the upper chassis unit 30 need not be pivotably attached to the main chassis unit 20, and the upper chassis unit 30 may instead by slidably attached to the main chassis unit 20. With this design, the ink packs 310 can be housed in a more stable condition within the upper chassis unit 30.

Figure 10:
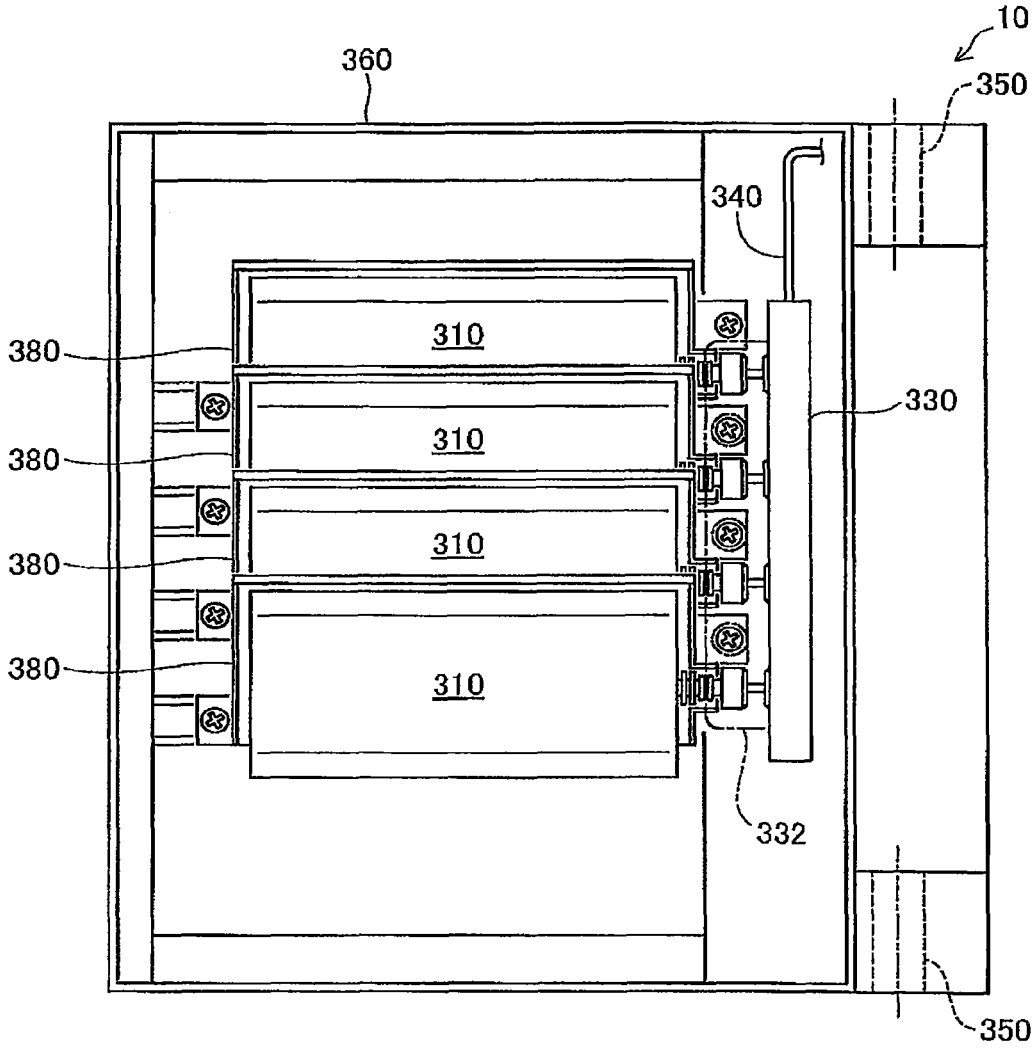
FIG. 10 is a top view showing the interior of the upper chassis unit.
Figure 11:
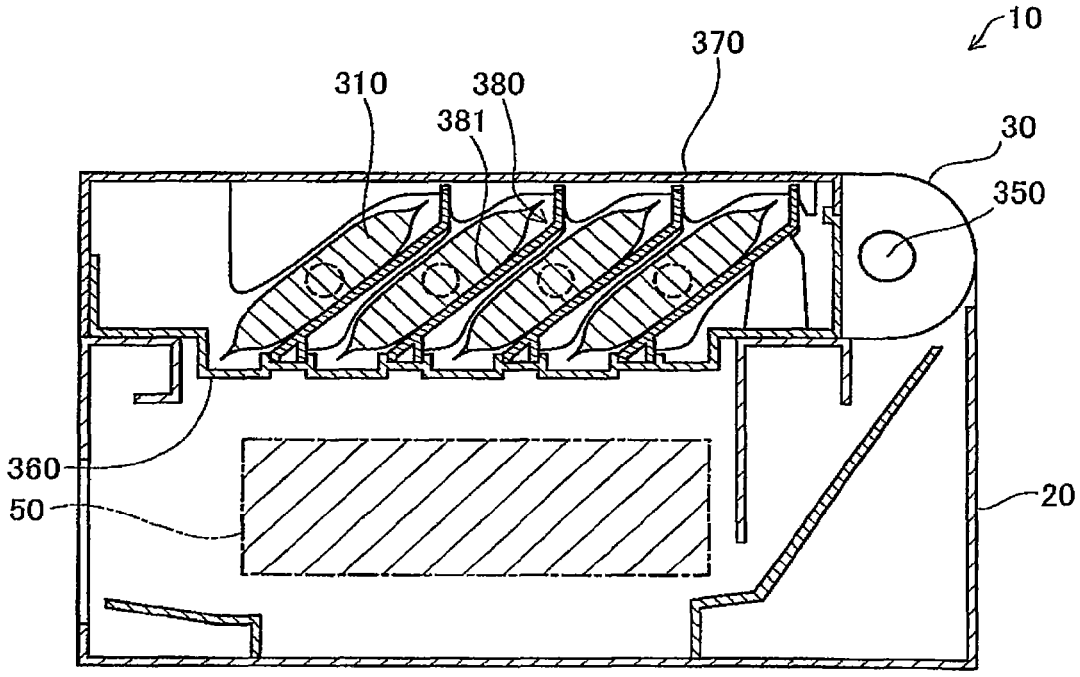
FIG. 11 is a sectional view depicting in simplified form the configuration of a printer, shown with the upper chassis unit closed.

Another possible orientation of the holders 380 on the lower housing 360 is that depicted in FIG. 10 wherein the holders 380 are arranged generally along the direction of the axis of the rotation shaft 350. According to the embodiment illustrated in FIG. 10, because the individual ink packs 310 held in the upper chassis unit 30 are maintained at generally identical height as the upper chassis unit 30 moves from the closed state to the open state, generally identical pressure head can be maintained in the inks contained in the individual ink packs 310. The ejection quality of the ink ejected from the ejection head 810 can be improved thereby. Alternatively, the holders 380 may be positioned with the direction of incline of the inclined panels 381 oriented towards the rotation shaft 350 as depicted in FIG. 11. According to the embodiment illustrated in FIG. 11, with the upper chassis unit 30 in the opened state the ink packs 310 rest in a more stable condition on the inclined panels 381 of the holders 380, as compared with the arrangement of the holders 380 depicted in FIGS. 2 and 3 in which the inclined panels 381 incline in the direction opposite from the rotation shaft 350.

The fluid targeted by the fluid ejection device of the invention is not limited to liquids such as the ink mentioned above, and various fluids such as metal pastes, powders, or liquid crystals may be targeted as well. The ink-jet recording device equipped with an ink-jet recording head for picture recording purposes like that described above is but one representative example of an fluid ejection device; the invention is not limited to recording devices of ink-jet type, and has potential implementation in printers or other picture recording devices; in coloring matter ejection devices employed in manufacture of color filters for liquid crystal displays and the like; in electrode material devices employed in formation of electrodes in organic EL (Electro Luminescence) displays or FED (Field Emission Displays); in liquid ejection devices for ejection of liquids containing bioorganic substances used in biochip manufacture; or in specimen ejection devices for precision pipette applications.

According to the aspect of the invention, the fluid ejection device may further comprise: a container case that houses the fluid-containing pack; and a fastening member that fastens the fluid container at the locking position to the container case, wherein: the fluid container includes a mating portion that mates with the fastening member in proximity to the withdrawal portion; and the guard cover includes a through-hole portion that locates corresponding to the mating portion of the fluid container at the locking position. According to the above-mentioned fluid ejection device, since the guard cover is disposed projecting so as to cover the delivery needle, while preventing accidental damage to the delivery needle during securing of the fluid container to the container case, the fluid container can be secured to the container case in the vicinity of connection between the delivery needle and the withdrawal opening.

According to the aspect of the invention, the fluid container may be a plurality of fluid containers; the fluid container may include a holder that inclines and holds the container portion; and the plurality of fluid containers may be arranged spaced apart with a part of one fluid container overlapping a holder of another fluid container. According to the above-mentioned fluid ejection device, the individual fluid containers are positioned at an incline, thereby allowing a plurality of fluid containers to be stacked and accommodated efficiently.

According to the aspect of the invention, the fluid ejection device may further comprise: a container case that houses the fluid-containing pack; and a main chassis case that houses the fluid ejection unit, wherein the container case is pivotably attached to the main chassis case and openable by rotation about a rotation shaft. According to the above-mentioned fluid ejection device, by opening the container case it will be possible to access the parts of the main chassis unit which are normally covered by the container case, thereby improving the degree of freedom in positioning of the fluid containers.

According to the aspect of the invention, the fluid container may incline by an angle which affords hold against the container portion from below in a direction of gravity as the container case moves from a closed position to a open position. According to the above-mentioned fluid ejection device, because the container portions of the fluid containers are retained from below as the container case moves from the closed state to the open state, the fluid container portions can be prevented from pushing with excessive force against other adjacent structures.

According to the aspect of the invention, the fluid container may be a plurality of fluid containers; and each of the withdrawal portions of the plurality of fluid containers may be arranged approximately along an axis of the rotation shaft. According to the above-mentioned fluid ejection device, as the container case moves from the closed state to the open state the individual fluid containers retained in the container case will be positioned at approximately identical height, thereby maintaining approximately identical pressure head of the fluid contained in the individual fluid containers. The fluid ejection quality can be improved thereby.

Although the invention has been described and illustrated in detail, it is clearly understood that the same is by way of illustration and example only and is not to be taken by way of limitation, the spirit and scope of the invention being limited only by the terms of the appended claims.

What is claimed is:

1. A fluid ejection device comprising:

a fluid ejection unit that ejects a fluid onto an ejection target;

a main chassis that includes an ejection area for ejecting the fluid onto the ejection target by the fluid ejection unit;

a container chassis that accommodates a fluid container, the fluid container containing a fluid for ejection, wherein the container chassis is pivotably attached to the main chassis case and openable by rotation about a rotation shaft; and a delivery needle adapted to connect with an aperture of the fluid container and arranged in the container chassis so that the delivery needle is inserted into the aperture in a direction along an axis of the rotation shaft.

2. The fluid ejection device according to claim 1, wherein the container chassis is pivotably attached to the main chassis allowing a part above the ejection area to be opened and closed.

3. The fluid ejection device according to claim 1, further comprising a fluid delivery portion that includes the delivery needle, wherein the fluid delivery portion is arranged in the container chassis so that the fluid delivery portion is adjacent to the fluid container in the container chassis in the direction along the axis of the rotation shaft.

4. The fluid ejection device according to claim 1, wherein the container chassis accommodates the fluid container so that a longitudinal direction of the fluid container is along the axial of the rotation shaft.

5. The fluid ejection device according to claim 1, wherein the delivery needle is one of plural delivery needles, and the plural delivery needles are arranged along a direction where the ejection target is fed.

6. The fluid ejection device according to claim 5, wherein the fluid container is one of plural fluid containers, and the plurality delivery needles are arranged so that a part of one fluid container overlaps another fluid container in a direction of gravity in the container chassis.

7. The fluid ejection device according to claim 1, further comprising a delivery passage that delivers the fluid from the fluid container to the fluid ejection unit via an outside region of the ejection area in the direction along the axis of the rotation shaft.

8. The fluid ejection device according to claim 1, wherein the rotation shaft is arranged upstream of the ejection area in a direction where the ejection target is fed.

* * * * *